US005361654A

United States Patent [19]

Rasipovits

[11] Patent Number: 5,361,654

[45] Date of Patent: Nov. 8, 1994

[54] GRIPPING HAND TOOL

[76] Inventor: Alex Rasipovits, 4008 Providence Dr., St. Charles, Mo. 63304-5545

[21] Appl. No.: 125,697

[22] Filed: Sep. 27, 1993

[51] Int. Cl.[5] ..... B25B 13/52

[52] U.S. Cl. ..... 81/64; 81/3.43; 81/125; 81/120

[58] Field of Search ..... 8/3.4, 3.43, 120, 121.1, 8/64, 125, 488

[56] References Cited

U.S. PATENT DOCUMENTS

| | | | |
|---|---|---|---|
| D. 298,006 | 10/1988 | Cooley . | |
| 2,701,491 | 2/1955 | Ross | 81/125 X |
| 2,752,811 | 7/1956 | Wenchel . | |
| 2,832,245 | 4/1958 | Burrows . | |
| 3,057,647 | 10/1962 | Wood | 81/64 UX |
| 3,322,007 | 5/1967 | Cunningham . | |
| 3,397,602 | 8/1968 | Estep et al. . | |
| 4,478,113 | 10/1984 | Berneiser . | |
| 5,279,188 | 1/1994 | Seeger et al. | 81/125 X |

*Primary Examiner*—James G. Smith

*Attorney, Agent, or Firm*—Polster, Lieder, Woodruff & Lucchesi

[57] ABSTRACT

A tool for the installation and removal of an elongated member such as a spark plug, with threads extending from an end through at least a part of the length of the member, takes the form of a tube, open at both ends, made of stiffly resilient expansible material, and a liner in the tube, fixed against movement relative to the tube. The liner is made of a compressible resilient material and has an axially extending passage, opening at both ends of the tube. The passage is defined by a cylindrical wall of the compressibly resilient material and is of a transverse cross-sectional size to permit insertion of the elongated member against the compressive bias of the liner, but to grip the elongated member when it is inserted to inhibit relative rotary motion of the elongated member and tube. The material of which the tube is made is sufficiently resilient to expand when the elongated member is forced into the liner passage, but stiff enough to maintain the passage substantially straight.

6 Claims, 1 Drawing Sheet

GRIPPING HAND TOOL

REFERENCE TO DISCLOSURE DOCUMENT

Subject matter of this application was disclosed in a disclosure document No. 329016, filed Apr. 12, 1993.

BACKGROUND OF THE INVENTION

In servicing modern automobile and truck gasoline engines, it is often difficult to reach the spark plugs for servicing. The engine compartment is not only more crowded than in older models, but frequently little working space is available between the engine and the surrounding sheet metal fenders, firewall and radiator. There have been attempts, from time to time, to provide a tool that overcomes the difficulties of conventional sparkplug tools. For example, Wenchel, U.S. Pat. No. 2,752,811, illustrates a socket wrench with a rubber insert. The socket wrench is of necessity not double ended, and the rubber insert is surrounded by an inelastic metal wall of the spark plug socket wrench. Burrows, U.S. Pat. No. 2,832,245, shows a similar socket wrench, which, like the wrench of Wenchel has a socket wrench part that necessarily engages the flatted sides of the spark plug when the spark plug is seated in the rubber insert. Thus, with the wrenches of Wenchel and Burrows, the spark plug cannot turn relative to the rubber sleeve if the threads of the spark plug and head become crossed or jammed. Cunningham, U.S. Pat. No. 3,322,007, shows a flexible rubber-like tube, with a handle at one end, for installing and removing spark plugs. Because the tube is flexible, it does not necessarily remained aligned, particularly if it is made sufficiently long to accommodate the requirements of some modern engines. Estep et al., U.S. Pat. No. 3,397,602, is another device in which a metal tube surrounds a rubber insert. In the case of Estep, the rubber insert is only deep enough to receive the terminal part of the spark plug. Berneiser, U.S. Pat. No. 4,478,113, shows a rubber tube with a sliding metal sleeve, and a handle in one end. Cooley, Des. U.S. Pat. No. 298,006, does not explain how it works, but it appears to be a tube of undisclosed material with a handle at one end. None of the references discloses a double ended tool, nor does any of them disclose a rigidly expansible outer tube with a compressibly resilient inner lining.

Normal engine servicing requires the removal, cleaning and reinstalling or replacement of the spark plugs. Rather than removing accessories or parts, service technicians prefer to work between and around obstructions. Existing tools for removing and installing spark plugs are not well adapted for holding a spark plug as it is being removed, or for permitting a spark plug to be properly aligned for installation in such a way as to eliminate or minimize the danger of cross-threading.

In many forms of internal combustion engines the well in which the spark plug is placed is so deep that it is difficult manually to line up the plug for threading it into the hole or to grasp it for removal of the loosened plug.

One of the objects of this invention is to provide a tool that is adapted to be used in the installation and removal of spark plugs or other elongated threaded members, which is slim and compact enough to permit its use on modern, crowded, engines with deep wells.

Another object is to provide such a tool which is simple, economical to make, dependable in use, where both ends of the tool are utilized, and the external surface is color coordinated.

Other objects will become apparent to those skilled in the art in the light of the following description and accompanying drawing.

SUMMARY OF THE INVENTION

In accordance with this invention, generally stated, a gripping hand tool is provided which comprises an outer tube that is stiffly but resiliently expandable, and a liner within the tube, which is made integral with the tube, but which is fixed against movement with respect to the tube. The liner is resiliently compressible, and has a passage opening at both ends of the tube. The passage is of a size to permit the insulator portion of a spark plug, for example, to be forced into the passage against the bias of the resiliently compressible liner, and against the bias of the resiliently expansible tube, compressing the liner and causing the tube to expand along the insulator. The insulator is gripped firmly by the tool, permitting the tool to be oriented so that the spark plug hangs down from it, without releasing the spark plug, and permitting the spark plug to be rotated with sufficient force to thread the threaded portion of the spark plug into the complementarily internally threaded opening in the engine head. The stiffness of the external tube is sufficient to maintain the tube and the bore of the liner in substantially a straight line, so that when the spark plug is rotated, it does not wobble. The force with which the spark plug is gripped by the tool is not enough to cause the threads of the spark plug or head to be stripped or jammed. The insulator of the spark plug can be inserted into either end of the tool. The tool is preferably color coded to distinguish the tool from other tools. The two ends of the tool can be identified distinctively so as to permit the use of one end until it is worn out, and the ready identification of the other end for its use.

DRAWINGS

In the drawing

DESCRIPTION OF THE PREFERRED EMBODIMENT

Figure 1:
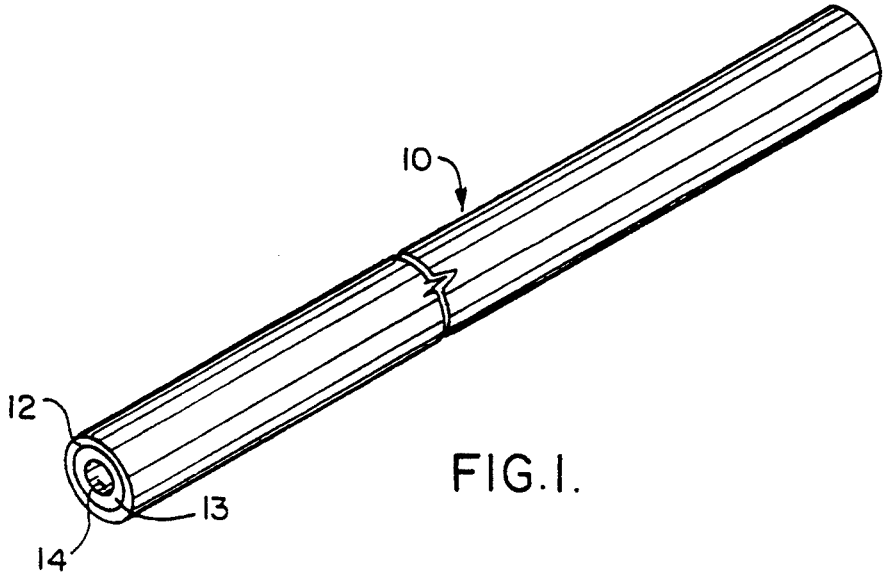
FIG. 1 is a broken perspective view of one embodiment of tool of this invention.

In the drawing, a complete tool 10 has an outer tube or sleeve 12, elongated axially and, in the embodiment shown, substantially uniformly circular in cross-section and in end view. In this embodiment, an inner liner 13 extends through the entire length of the tube 12. The liner 13 has an inner wall surface 14 that defines a straight bore 11, open at both ends of the tube 12.

The outer tube 12 is made of a stiffly resiliently expansible material, such as polyvinyl chloride (PVC compound), or a synthetic equivalent, which in the thickness here used, is stiffly resiliently expansible. That is to say, under internal pressure, it will expand, and when the pressure is relieved, will return to its initial condition. At the same time, it is sufficiently stiff to preserve its integrity as a straight tube, with a substantially straight axial center line around which it can be rotated. The center line of the bore defined by the wall 14 of the liner is coincident with the center line of the tube.

The inner liner 13 can be made of a resiliently compressible material, such as thermoplastic/polyvinyl chloride (PVC compound), sponge rubber or a synthetic equivalent. It can be glued, bonded or otherwise secured into place, or it can co-extruded with the tube. In any case, it is made integral with the tube in that it is fixed against axial or rotational movement with respect to the tube.

Figure 2:
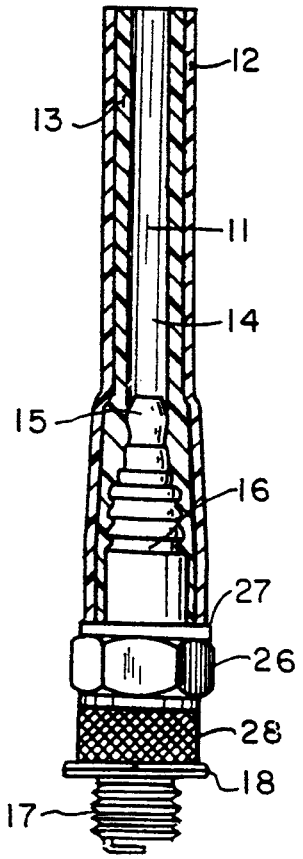
FIG. 2 is a longitudinal sectional view of the tool shown in FIG. 1, with a spark plug in place.
Figure 3:
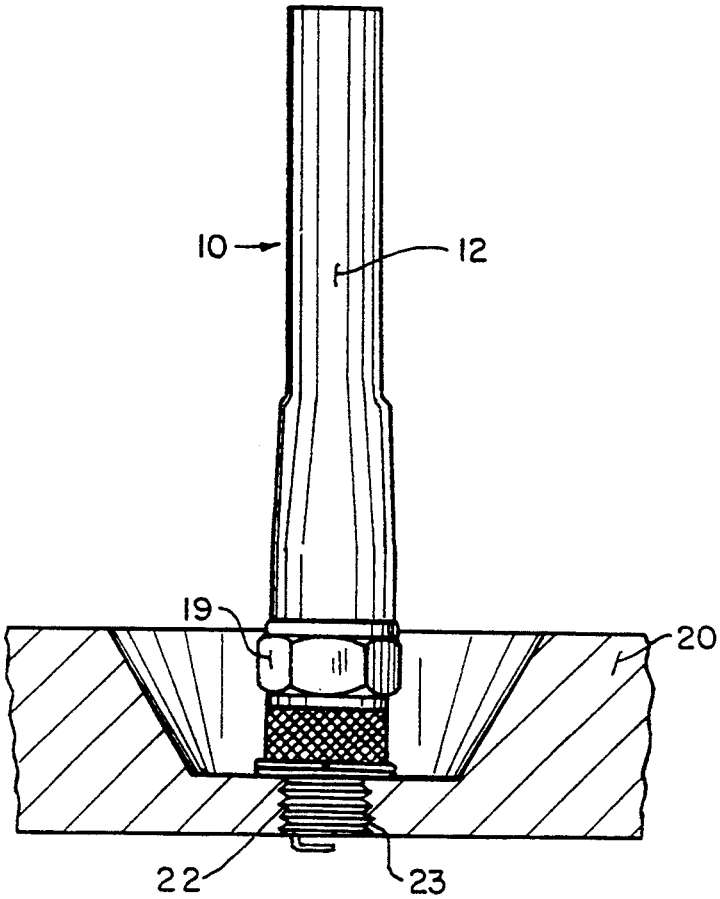
FIG. 3 is a view in side elevation of the tool, showing it being used to install or remove a spark plug.

In FIGS. 2 and 3, the tool is shown in use in removing or installing a spark plug 19. The spark plug 19 is conventional, with a terminal 15, an elongated porcelain insulator 16, a flatted section 26 formed to receive complementary flats of a spark plug socket wrench, a knurled cylindrical section 28 with a radially planar surface against which a gasket 18 is seated, and an externally threaded lower section with threads 17.

A planar radial upper surface 27 of the flatted part 26 surrounds the insulator 16.

The bore 11 of the liner 13 is sized to admit the terminal 15, and to permit the insulator 16 to be forced entirely into the tube, against the compressive bias of the liner. The compression of the liner by the insulator 16 causes the tube 12 to expand, as shown particularly in FIGS. 2 and 3. The external configuration of the tube 12 will vary with the configuration of the spark plug insulator, and will not be precisely that which is shown in FIGS. 2 and 3, but those figures do indicate that the tube has expanded in response to the compression of the liner by the spark plug. Preferably, the insulator 16 is forced into tube 13, towards surface 27 and far enough to hold spark plug 19 adequately.

The resilient expansion of the tube 12 reinforces the holding power of the tool, but at the same time, the tube both maintains the substantial integrity of the axial center line of the bore. The grip of the tool is such that when undue rotary torque is applied to the tube, it can permit rotation of the tool with respect to the insulator 16.

In FIG. 3, the tool is shown as being used to install the spark plug 19 into a hole 23 in the bottom of a well in a cylinder head 20 of an internal combustion engine or to remove it therefrom. The hole 23 has internal threads 22 complementary to the threads 17 of the spark plug.

Because the tube is double ended, the spark plug can be inserted in either end, which in effect doubles the life of the tool. In addition, by leaving the tube plain, without handle or other protuberance, it can not only be manipulated easily, but the size, light weight, and shape of the tool permit the user to sense when the threads 17 and 22 may start to cross, so that the spark plug can be realigned and started again.

The tool is preferrably color coded, both to distinguish it from other tools in a tool box, and, if the two ends are coded differently, to identify the two ends of the tool so as to permit the user to identify an end that has become worn.

In use, in installing a spark plug, the spark plug insulator is inserted into one end of the tool against the bias of the liner and of the outside tube. Because in most spark plugs the porcelain insulator flares at the end adjacent the surface 27, the gripping force of the tool is greatest at that point, where the porcelain insulator is strongest. When the insulator is inserted far enough, it is protected by the tool. The tool holds the spark plug firmly, so that it can be easily manipulated to the threaded opening in the cylinder block, and tightened to finger tightness. The tool is then easily pulled straight off the insulator, and the final tightening to proper torque is accomplished with a conventional spark plug socket wrench. In removing the spark plug, the plug is first loosened with a conventional socket wrench, and the gripping tool is then pushed onto the insulator towards surface 27, and the spark plug is then unscrewed and removed. Because there is no metal in the tool, the danger of breaking the insulator accidentally or cracking it in the course of its insertion into the tool, and then into the cylinder head hole is practically eliminated. At the same time, because the external tube 12 is stiff, it is easy to guide the tool over the insulator.

Merely by way of illustration, the tool can vary in length, for example: from three and one half ($3\frac{1}{2}$) inches long to eight and one half ($8\frac{1}{2}$) inches long, with an outside diameter of five eighths ($\frac{5}{8}$) of an inch and an inside diameter of three eighths ($\frac{3}{8}$) of an inch. When the external tube is made of stiffly expandable PVC and the internal "liner" is made of resiliently compressible PVC, they can be co-extruded, in which case, the inner and outer wall thicknesses of the PVC can be one eighth ($\frac{1}{8}$) of an inch.

Numerous variations in the construction of the tool of this invention, within the scope of the appended claims, will occur to those skilled in the art in the light of the foregoing disclosure. Merely by way of example, the dimensions of the tool can be varied. The relative thicknesses of the tube and liner can be varied, depending upon the materials of which they are made and the desired amount of gripping force to be exerted. Other materials can be used, as for example, polypropylene for the tube and Neoprene for the liner, or polyethylene in compressibly resilient form as the liner and in the form of a heavy skin as the tube. The tool can be adapted for use in the installation of other threaded members, such, for example, as set screws to be inserted into or removed from deep counter-bores in large hubs, for example. These are merely illustrative.

I claim:

1. A tool for installation and removal of an elongated member having external threads extending from an end through at least a part of its length, said threads engaging a complimentarily internally threaded member, said tool comprising a hollow tube of stiffly resiliently expansible material, open at both ends, and a liner in said tube fixed against movement relative to said tube, said liner being resiliently compressible, said liner having an axially extending passage, said passage opening at both ends of said tube and being of a transversely cross-sectional size sufficiently less than a portion of said elongated threaded member beyond said internally threaded member-engaging external threads to grip said portion when said portion is forced into said passage from either end of said tube, the forcing of said portion into said passage compressing said liner and causing said tube to expand through at least a part of the length of said portion within said tube.

2. A tool for installing and removing a spark plug from a gasoline engine, said spark plug having a threaded end, a flatted intermediate part and an elongated insulator projecting from said intermediate part in a direction away from said threaded end, said tool comprising a stiffly resilient, expansible hollow tube, open at both ends, and a liner in said tube extending through the full length of said tube and fixed against movement relative to said tube, said liner being resiliently compressible, said liner having an axially extending passage defined by a cylindrical wall, said passage opening at both ends of said tube and being of an internal diameter to permit said insulator to be forced, against the bias of said resiliently compressible liner, into said tube through the entire length of said insulator, from either end of said tube, the forcing of said insulator into said liner passage causing said tube to expand through at least a part of the length of said insulator, said tube being of sufficient stiffness to maintain a substantially straight axial bore.

3. The tool of claim 1 wherein the tube is made of polyvinyl chloride.

4. The tool of claim 1 wherein the liner is integral with the tube.

5. The tool of claim 3 wherein the liner is sponge rubber, the outer tube wall is 0.031 inches thick, and the inner liner wall, 0.094 inches thick.

6. The tool of claim 2 wherein the two ends of the tool are marked distinctively differently from one another.

* * * * *